US012742618B2

(12) United States Patent
Niles

(10) Patent No.: US 12,742,618 B2
(45) Date of Patent: Sep. 22, 2026

(54) TARGET SYSTEM

(71) Applicant: Ark Inventive LLC, Sherwood, OR (US)

(72) Inventor: Tyler Bradford Niles, Tigard, OR (US)

( * ) Notice: Subject to any disclaimer, the term of this patent is extended or adjusted under 35 U.S.C. 154(b) by 804 days.

(21) Appl. No.: 18/063,967

(22) Filed: Dec. 9, 2022

(65) Prior Publication Data

US 2024/0191978 A1 Jun. 13, 2024

(51) Int. Cl.
*F41J 2/00* (2006.01)
*F41J 9/00* (2006.01)
*F41J 9/02* (2006.01)

(52) U.S. Cl.
CPC .. *F41J 9/02* (2013.01); *F41J 2/00* (2013.01)

(58) Field of Classification Search
CPC .... F41J 9/00–32; F41J 1/10; F41J 1/00; F41J 3/0004; F41J 7/00–06; A63B 63/00–083; A63B 2063/086
USPC ..... 273/359, 369–371, 378–393, 395, 403, 273/406, 407
See application file for complete search history.

(56) References Cited

U.S. PATENT DOCUMENTS 1,157,342 A * 10/1915 Thompson ..... F41J 7/02 273/406
1,164,910 A 12/1915 Ayer
3,140,874 A 7/1964 Jensen et al.
3,614,102 A * 10/1971 Nikoden, Sr. ..... F41J 9/02 273/406
3,770,914 A * 11/1973 Larsen ..... H02G 11/02 191/12.2 A
3,782,728 A * 1/1974 Yasuda ..... F41J 7/04 434/25
3,865,373 A * 2/1975 Knight ..... F41J 9/02 273/369
5,367,232 A 11/1994 Netherton et al.
5,688,196 A * 11/1997 O'Neil ..... A63B 63/06 473/439
5,951,016 A * 9/1999 Bateman ..... F41J 7/00 273/406
5,967,522 A * 10/1999 Corcoran ..... F41J 7/02 273/406

(Continued)

FOREIGN PATENT DOCUMENTS

CH 6660782 A5 6/1987
CN 106871730 A * 6/2017 ..... F41J 1/01

(Continued)

OTHER PUBLICATIONS

The PCT Search Report and Written Opinion mailed Feb. 16, 2024 for PCT Application No. PCT/US2023/082281 from PCT Summary. 11 pages.

*Primary Examiner* — Kiley S Stoner
(74) *Attorney, Agent, or Firm* — Jeffrey K. Riddle; Riddle IP, PLLC

(57) ABSTRACT

A target system may include a carrier. The carrier may include a housing, at least one wheel rotatably coupled to an interior of the housing, at least one gear coupled to the at least one wheel, a motor coupled to the at least one gear to drive the at least one wheel via the at least one gear, and a controller to activate the motor based on user input. The target system may also include at least one arm coupled to the carrier, and a coupling device to couple a panel to the at least one arm.

20 Claims, 8 Drawing Sheets

(56) References Cited

U.S. PATENT DOCUMENTS

| | | | | | |
|---|---|---|---|---|---|
| 6,159,112 | A * | 12/2000 | Ciluffo | A63B 69/0026 | 124/4 |
| RE38,540 | E * | 6/2004 | Bateman | F41J 9/02 | 273/406 |
| 7,052,012 | B2 * | 5/2006 | Dehart | F41J 7/00 | 273/354 |
| 7,900,927 | B1 * | 3/2011 | Bliehall | F41J 9/02 | 273/390 |
| 8,777,226 | B1 * | 7/2014 | Decker, Jr. | F41J 7/06 | 463/2 |
| 9,534,873 | B2 * | 1/2017 | Urban | F41J 1/10 | |
| 9,927,215 | B2 * | 3/2018 | Harris | F41J 7/00 | |
| 9,982,970 | B2 | 5/2018 | Roemer | | |
| 2008/0088089 | A1 * | 4/2008 | Bliehall | F41J 9/02 | 273/359 |
| 2008/0194337 | A1 * | 8/2008 | Hensel | F41A 33/00 | 463/52 |
| 2016/0054104 | A1 * | 2/2016 | Harris | F41J 7/00 | 273/368 |
| 2016/0138895 | A1 * | 5/2016 | Beine | F41J 5/10 | 434/19 |
| 2016/0273889 | A1 * | 9/2016 | Roemer | F41J 1/10 | |
| 2017/0059283 | A1 * | 3/2017 | Parrish | F41J 5/02 | |
| 2017/0205207 | A1 * | 7/2017 | Anderson | F41J 1/10 | |
| 2017/0348582 | A1 * | 12/2017 | Cho | A63B 69/40 | |
| 2018/0045495 | A1 * | 2/2018 | Harris | F41J 7/06 | |
| 2018/0164082 | A1 | 6/2018 | Billington | | |
| 2021/0208557 | A1 * | 7/2021 | Green | F41J 9/02 | |
| 2023/0033184 | A1 * | 2/2023 | Edwards | F41J 9/02 | |
| 2023/0228540 | A1 * | 7/2023 | Gries | F41J 7/02 | 273/359 |
| 2024/0191978 | A1 * | 6/2024 | Niles | F41J 1/10 | |

FOREIGN PATENT DOCUMENTS

| | | | | | |
|---|---|---|---|---|---|
| CN | 108168376 | A * | 6/2018 | F41J 7/06 | |
| CN | 109059665 | A * | 12/2018 | F41J 1/01 | |
| CN | 109282706 | A * | 1/2019 | F41J 7/00 | |
| CN | 109297361 | A * | 2/2019 | F41J 9/00 | |
| CN | 109556462 | A * | 4/2019 | F41J 9/02 | |
| CN | 110440641 | A * | 11/2019 | F41J 9/02 | |
| CN | 110671975 | A * | 1/2020 | F41J 9/08 | |
| CN | 111895854 | A * | 11/2020 | F41J 5/14 | |
| CN | 113280681 | A * | 8/2021 | F41A 33/00 | |
| CN | 214842789 | U | 11/2021 | | |
| CN | 113883968 | A * | 1/2022 | F02N 11/08 | |
| DE | 102013019808 | A1 * | 5/2015 | F41J 1/10 | |
| GB | 1367752 | A * | 9/1974 | F41J 9/02 | |
| GB | 2420722 | A * | 6/2006 | A63B 69/36 | |
| GB | 2505506 | A * | 3/2014 | A63B 69/34 | |
| JP | 09217999 | A * | 8/1997 | | |
| JP | H09217999 | A * | 8/1997 | F41J 7/02 | |
| JP | H1082600 | A * | 3/1998 | F41J 7/06 | |
| JP | 3051974 | B2 * | 6/2000 | F41J 7/02 | |
| KR | 200325705 | Y1 * | 9/2003 | F41J 9/00 | |
| KR | 101543730 | B1 * | 8/2015 | F41J 7/00 | |
| KR | 1622719 | B1 * | 5/2016 | | |
| KR | 101622719 | B1 * | 5/2016 | F41J 9/08 | |
| WO | WO-2009122407 | A1 * | 10/2009 | A63B 69/3623 | |
| WO | WO-2019243302 | A1 * | 12/2019 | A01G 23/006 | |

* cited by examiner

TARGET SYSTEM

TECHNICAL FIELD

The present disclosure relates generally to firearm targets. Specifically, the present disclosure relates to systems, devices, methods, and computer-readable medium for deploying a moving target system.

BACKGROUND

Targets have been used for centuries to assist marksmen in improving their shooting skills and accuracy. Targets may come in various sizes and configurations to match the intent and needs of the user. Some targets may be moveable. The ability to move a target allows for the mimicking of movement of an animal a marksman may encounter in the field or a human that may be encountered in, for example, a self-defense, military, or policing situation. Further, moving a target may increase difficulty for the marksman and further enhances a target practice session.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference numbers in different figures indicates similar or identical items. The systems depicted in the accompanying figures are not to scale and components within the figures may be depicted not to scale with each other.

DESCRIPTION OF EXAMPLE EMBODIMENTS

Figure 1:
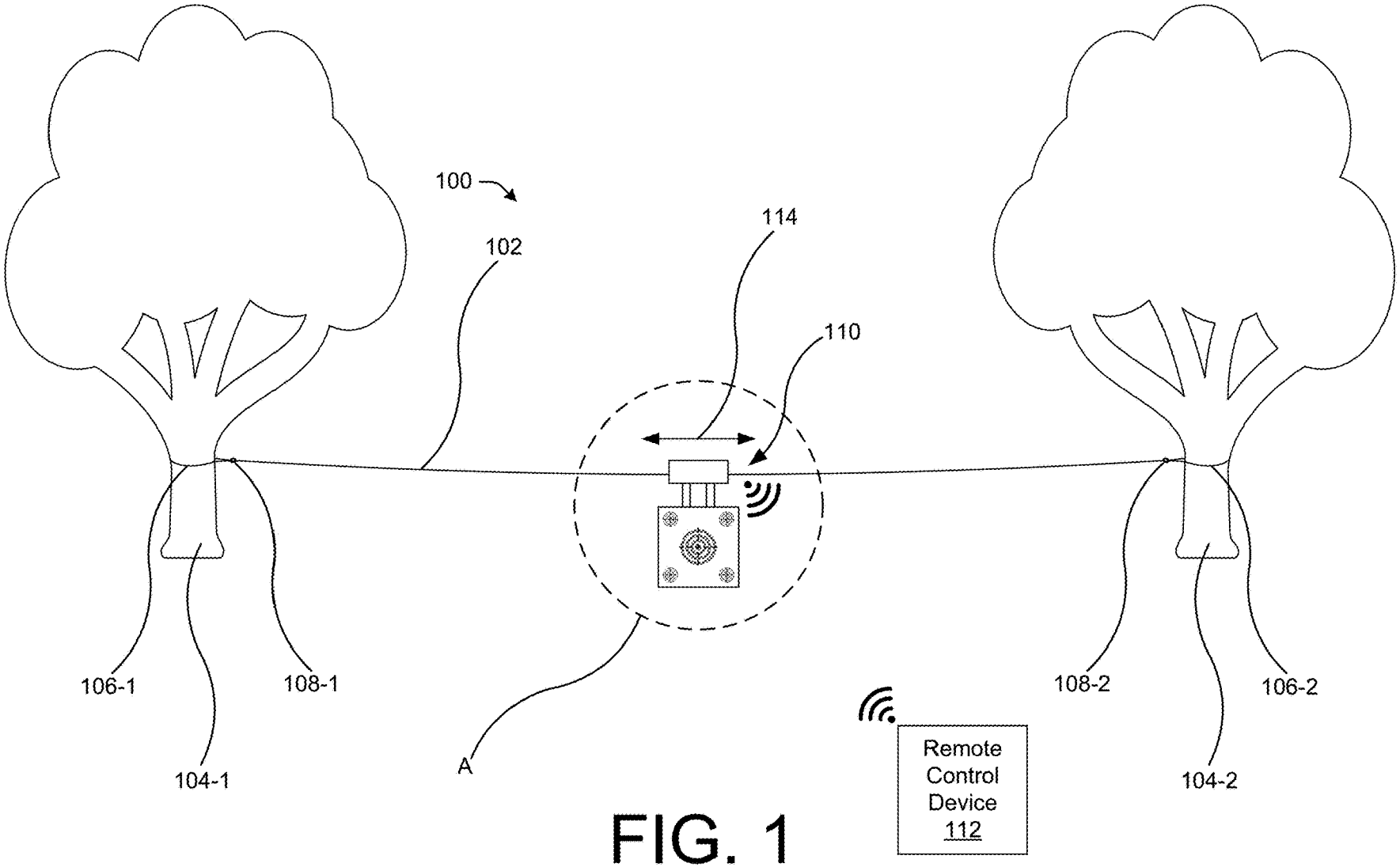
FIG. 1 illustrates a system diagram of a target system, according to an example of the principles described herein.

Some moving target systems may have a number of disadvantages. For example, some moving target systems may be non-portable fixtures restricting the utility of the targeting systems. Further, even fairly portable target systems may still be difficult to transport or assemble. Still further, many targets do not adequately challenge a user to improve their accuracy, either due to the stationary nature of the target, or because the movement of a moving target is predictable, unrealistic, or otherwise simplistic in manner.

A user may find it difficult to operate a moving target during the target practice session. Operation of the moving target system may be especially difficult if the marksman is alone and without assistance during the target practice session. This may require the marksman to operate the target system themselves creating both a less effective training session and adding risk of accidental discharge of the firearm by the marksman that may, in turn, increase a risk of harm to the marksman and others. Still further, operation of a moving target system may require mechanics to be extended from the firing range to the marksman to operate the moving target system. This may result in an increase in complexity and time to arrange the moving target system and may result in a higher probability of failure due to the increased number of parts within the moving target system.

Still further, some moving target systems may not provide a desired level of difficulty in certain scenarios such as tactical training that may require more rigorous and unpredictable movements. It may be difficult for a moving target system to provide for such rigorous movements. Further, operation of some moving target systems may be dangerous since, in some instances, an individual may be downrange and may be placed in danger of being hit by a stray bullet, a ricochet, or errantly aimed shot.

The present systems and methods disclosed herein provide for a simple to use, cost-effective, indoor- and outdoor-rated, portable, suspended, moving target carrier for firearms training. An individual marksman may assemble, use, and disassemble the target system within minutes and without the need of additional tools. A user may attach a backer such as a cardboard backer or other backing for which to affix any number of standard or custom practice targets at which the marksman may shoot. Using only two arbitrary anchor points such as trees or posts to establish a slack or taut suspension line, the systems may be quick and simple to assemble and disassemble in a matter of minutes and without any special tools. The present systems and methods disclosed herein further include the suspension line and associated hanging hardware, along with a monolithic target carrier device which attaches directly to the suspension line. The monolithic target carrier may be battery powered and may be driven by a motor and associated mechanics that are internal to the target carrier. The systems and methods are able to be controlled remotely to cause the target carrier to move along a first direction of the suspension line, along a second direction of the suspension line, to stop, to pause, to delay movement, and may include software-enabled patterns. Further, a target carrier of the target systems described herein may travel back and forth along a suspended line at variable speeds between approximately 0-20 mph or more. Software-enabled control may be included in the target carrier and associated operation software that allows hunters to practice rifle marksmanship on a target that behaves like a grazing (e.g., slow moving), then spooked (e.g., a pause), and/or sprinting away (e.g., fast moving) game animal. Further, the present disclosure provides a weather resistant target carrier that is able to operate outdoors in diverse dry and wet climates and in multiple seasons.

The present disclosure provides a remotely controllable target carrier for practicing marksmanship and tactical drills on a moving target. Further, as the target system and carrier operate on a suspended line, the existence or topography of the surrounding ground terrain is irrelevant to the operation of the target system and carrier, which is a significant advantage in many outdoor and indoor applications. The systems and methods described herein are directed towards enabling even a novice or recreational marksman to have access to a premier training function including shooting at moving targets since the device may be deployed in a backyard personal range, a private indoor or outdoor range, or on public lands. The present systems and methods may also be usefully employed in advanced tactical training facilities such as tactical shoot houses or law enforcement and military training arenas. The present systems and methods may be controlled wirelessly by either a remote control device (e.g., radio frequency (RF) control device) or a mobile device (e.g., a smartphone or tablet) or app executed on a mobile device.

Because of these capabilities, the present systems and methods may be safely and successfully utilized by an individual marksman or team of marksmen simultaneously. Due to the nature of the suspended line, a 360° range is possible provided all safety precautions are observed as to down-range objects and individuals. Only two anchor points are required to establish the path of the suspended line which allows training to either remain on a square range or to move away from a square range by placing the system to travel at arbitrary angles such as front to back, side to side, corner to corner, and any angle in between. As a result, a highly flexible, ultra-portable, unique target carrier system is provided that may be deployed and utilized in a wide variety of settings. This unique mix of characteristics may prove beneficial to the everyday marksman who only has access to public lands for training and may similarly prove beneficial to any member of a private range or gun club where the marksmen may bring in their own gear, but are required to also pack their equipment back out. This invention brings to the every day marksman capabilities typically reserved only for elite training facilities.

Overview

Examples described herein provide a target system including a carrier. The carrier may include a housing, at least one wheel rotatably coupled to an interior of the housing, at least one gear coupled to the at least one wheel, a motor coupled to the at least one gear to drive the at least one wheel via the at least one gear, and a controller to activate the motor based on user input. The carrier may further include at least one arm coupled to the carrier, and a coupling device to couple a panel to the at least one arm.

The target system may further include a suspension line. The carrier hangs from the suspension line via at least one of the wheels. The target system may further include a transceiver communicatively coupled to the controller and a remote control device communicatively coupled to the transceiver via a wireless communication protocol. The remote control device may transmit the input. The remote control device transmits the input to the transceiver. The input causes the controller to activate the motor to move in a first direction, move in a second direction, stop, pause, delay, reduce speed during movement, reduce acceleration during movement, increase speed during movement, increase acceleration during movement, move randomly, move in a predefined pattern, and combinations thereof.

The at least one wheel may include at least two wheels. A first wheel of the at least two wheels is contrapositioned to a second wheel of the at least two wheels with respect to a suspension line selectively threaded between the first wheel and the second wheel. The target system may further include a clutch mechanically coupled to the at least one wheel to selectively engage and disengage the at least one wheel from a suspension line. The target system may further include an aperture defined in the housing through which a suspension line is selectively engageable and disengageable with the at least one wheel. The housing may be made of a hardened steel configured to withstand gunfire.

Examples described herein also provide a target carrier. The target carrier may include a housing, at least one wheel rotatably coupled to an interior of the housing, at least one gear coupled to the at least one wheel, a motor coupled to the at least one gear to drive the at least one wheel via the at least one gear, and a controller to activate the motor based on user input.

The target carrier may further include at least one arm coupled to the housing, and a coupling device to couple a panel to the at least one arm. The target carrier may further include a transceiver communicatively coupled to the controller. The transceiver may be configured to communicate with a remote control device via a wireless communication protocol. The remote control device may transmit the input to the controller via the transceiver. The controller is configured to receive the input via the transceiver. The input causes the controller to activate the motor to move in a first direction, move in a second direction, stop, pause, delay, reduce speed during movement, reduce acceleration during movement, increase speed during movement, increase acceleration during movement, move randomly, move in a predefined pattern, and combinations thereof.

The at least one wheel may include at least two wheels. A first wheel of the at least two wheels is contrapositioned to a second wheel of the at least two wheels with respect to a suspension line selectively threaded between the first wheel and the second wheel. The target carrier may further include a clutch mechanically coupled to the at least one wheel to selectively engage and disengage the at least one wheel from a suspension line.

The target carrier may further include an aperture defined in the housing through which a suspension line is selectively engageable and disengageable with the at least one wheel. The housing may be made of a hardened steel configured to withstand gunfire.

Examples described herein also provide a target system. The target system may include a carrier. The carrier may include a housing, at least one wheel rotatably coupled to an interior of the housing, at least one gear coupled to the at least one wheel, a motor coupled to the at least one gear to drive the at least one wheel via the at least one gear, and a controller to activate the motor based on user input. The target system may further include at least one arm coupled to the carrier, a coupling device to couple a panel to the at least one arm, and a suspension line. The carrier hangs from the suspension line via the at least one wheel.

The at least one wheel may include at least two wheels. A first wheel of the at least two wheels is contrapositioned to a second wheel of the at least two wheels with respect to a suspension line selectively threaded between the first wheel and the second wheel. The target system may further include a clutch mechanically coupled to the at least one wheel to selectively engage and disengage the at least one wheel from a suspension line. The target system may further include an aperture defined in the housing through which a suspension line is selectively engageable and disengageable with the at least one wheel.

Examples described herein also provide a non-transitory computer-readable medium storing instructions that, when executed, causes a processor to perform operations including operations associated with the systems, methods, applications, data, and computer program products described herein.

Additionally, the techniques described in this disclosure may be performed as a method and/or by a system having non-transitory computer-readable media storing computer-executable instructions that, when executed by one or more processors, performs the techniques described above.

Example Embodiments

Turning now to the figures, FIG. 1 illustrates a system diagram of a target system 100, according to an example of the principles described herein. The target system 100 described herein may be used in a number of scenarios and settings. For example, the target system 100 may be used in an outdoor setting such as the setting depicted in FIG. 1. However, the target system 100 as described herein may be used in any scenario or setting in which shooting may occur. In one example, the target system 100 may be deployed in an area where safe firearm use may occur. In one example, the target system 100 may be deployed indoor, outdoor, at a private indoor or outdoor firearm range (e.g., a personal backyard), at a third party firearm range, public lands, advanced tactical training facilities (e.g., tactical shoot houses), law enforcement or military training areas, and other areas. Further, the target system 100 may be used in specific types of training including self-defense training, law enforcement training, tactical training, military training, competitive shooting training, competitive shooting competitions, and other scenarios.

The target system 100 may include a suspension line 102 (e.g., a rope or cable) that may be coupled to two stanchions or similar upright objects such as two trees 104-1, 104-2, for example. A loop 106-1, 106-2 may be located at each end of the suspension line 102 that may be strung around the two trees 104-1, 104-2. Further, coupling devices 108-1, 108-2 may be used to couple the loops 106-1, 106-2 to the suspension line 102. In one example, the loops 106-1, 106-2 may include nylon webbing or straps. The ends of the nylon webbing or straps may be coupled together via a buckle, a side release buckle, S-hooks, snap hooks, bolt/anchor plates, J-hooks, flat hooks, end fittings (e.g., S-hooks, snap hooks, bolt/anchor plates, J-hooks, flat hooks, etc.), fasteners (e.g., over-center, cam, ratchet, etc.), buckles (e.g., slide buckles, snap buckles, etc.), other coupling devices, and combinations thereof. In one example, the coupling device used to cause the loop 106-1, 106-2 to loop around and couple to the tree 104-1, 104-2 may include a ratchet allows a user to ratchet the loop 106-1, 106-2 to a tighter, shorter diameter to tighten around the tree 104-1, 104-2.

The suspension line 102 may be coupled to the loops 106-1, 106-2 via the coupling devices 108-1, 108-2 such as a carabiner or similar device through which the suspension line 102 and the loops 106-1, 106-2 may be threaded. Further, in one example, the suspension line 102 may also include a ratchet (not shown) coupled between one or more of the loops 106-1, 106-2 and an end of the suspension line 102 to allow a user to selectively slacken or tighten the suspension line 102 and provide for varied tensions on the loops 106-1, 106-2, the carabiners 108-1, 108-2 and the suspension line 102.

The target system 100 may further include a target carrier 110. The target carrier 110 may be coupled to the suspension line 102 and allowed to travel along a distance of the suspension line 102 in either direction as indicated by arrow 114. In one example, a remote control device 112 may be included in the target system 100. As described herein in more detail, the remote control device 112 may control one or more functions of the target carrier 110 including, for example, the movement of the target carrier 110 along the length of the suspension line 102.

Figure 2:
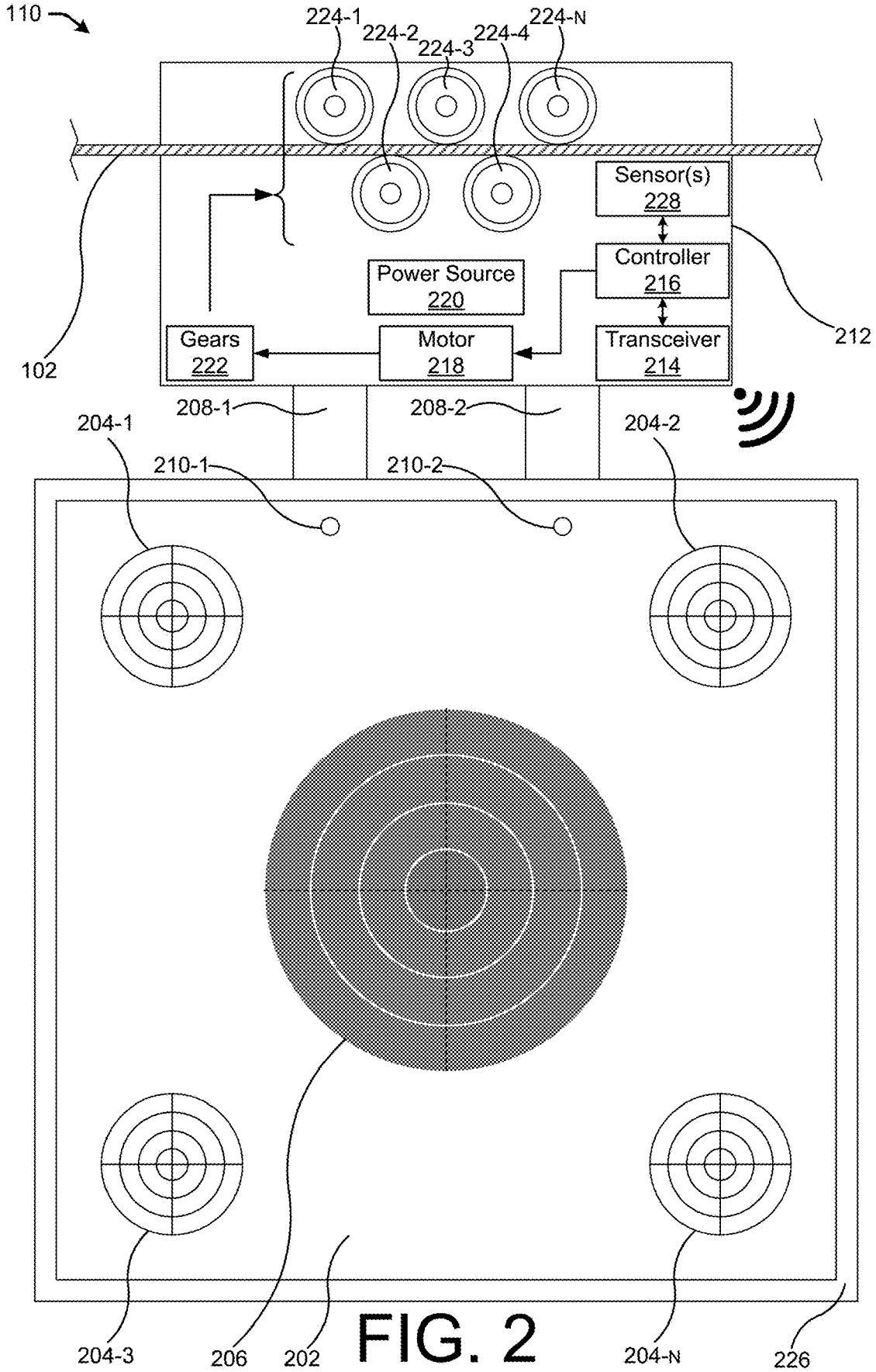
FIG. 2 is a front, system diagram of a target carrier of section A of FIG. 1, according to an example of the principles described herein.
Figure 3:
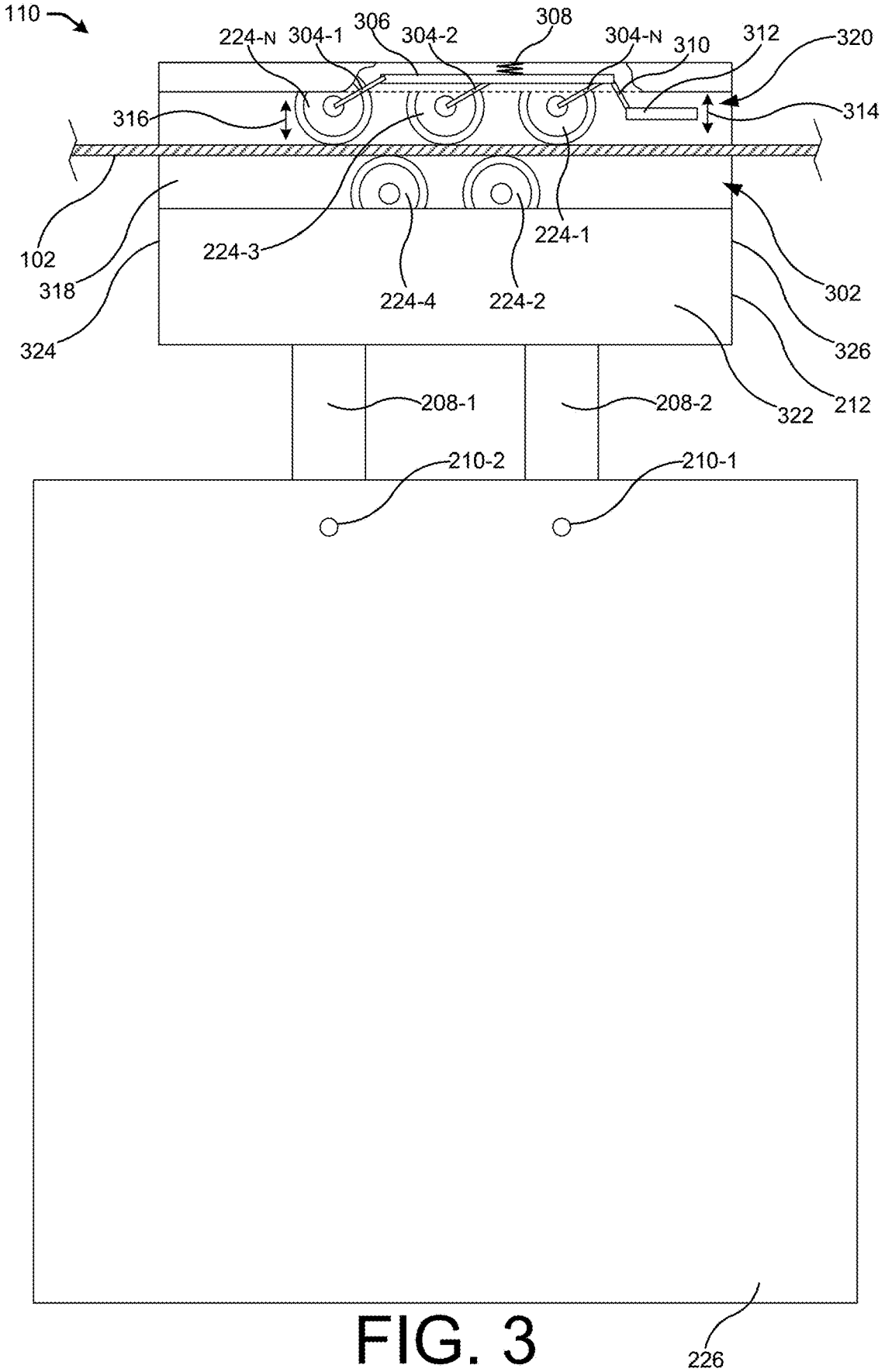
FIG. 3 is a back, system diagram of a target carrier of section A of FIG. 1, according to an example of the principles described herein.

FIG. 2 is a front, system diagram of a target carrier 110 of section A of FIG. 1, according to an example of the principles described herein. FIG. 3 is a back, system diagram of a target carrier 110 of section A of FIG. 1, according to an example of the principles described herein. The target carrier 110 may be used to carry a target sheet 202 along the length of the suspension line 102. In one example, the target sheet 202 may include a primary target 206 and a plurality of relatively smaller secondary targets 204-1, 204-2, 204-3, 204-N, where N is any integer greater than or equal to 1 (collectively referred to herein as secondary target(s) 204 unless specifically addressed otherwise). The primary target 206 and the secondary targets 204 are depicted as being cross-hair type targets. However, the primary target 206 and/or the secondary targets 204 may have a shape including shapes of animals and/or humans.

In one example, the target carrier 110 may include a housing 212 to contain and arrange a number of elements of the target carrier 110 that cause the functionality described herein. Because the housing 212 is expected to be in the line of fire and may be struck by an errant round fired from a firearm, in one example, the housing 212 may include metal such as a hardened steel (e.g., AR500 and AR550 steel). In one example, the housing 212 may be made of a plastic or polymer and may include an optional steel plate or plates for protection of the plastic or polymer housing. In one example, the housing may include a completely protective steel housing.

In one example, the target carrier 110 may include a housing 212 made of any material, and a number of protective plates may be coupled to one or more sides of the housing 212. In this example, one or more soft or hard plates may be coupled to the housing 212 using any coupling methods and devices. In one example, the protective plates may be selectively coupled and decoupled to and from the housing 212 and may be replaced in instances where the protective plates are depleted or otherwise destroyed or damaged through a number of bullets striking the protective plates. In this manner, the protective plates may be replaceable elements of the target system 100.

In one example, the one or more protective plates may be lightweight to allow for the target carrier 110 to move relatively more freely during operation. In one example, the one or more protective plates may be made of a polyethylene, ultra-high molecular-weight polymer, (UHMWPE), ceramic, alloy, and/or polymer blends, aromatic polyamide (e.g., Aramid), p-aramid (e.g., Rimelig), para-aramid (e.g., Kevlar), other materials, and combinations thereof. In one example, the protective plates may be approximately 50% to 70% lighter relative to, for example, equivalently-sized steel plates. In one example, the one or more protective plates may be made of hardened (e.g., martensitic) steel, steel alloys, other metals and metal alloys, and combinations thereof.

In one example, any type of protective, bullet resistant or bullet proof protective plate may be coupled to the target carrier 110 to protect the target carrier 110 during a firearm shooting instance. In the examples described herein, the protective plates may be sold as a part of a kit associated with the target system 100 and/or the target carrier 110, sold as separate elements, and combinations thereof.

In one example, the target carrier 110 may include arms 208-1, 208-2 coupled to and extending from a bottom portion of a housing 212. The target sheet 202 may be coupled to a target support 226. It is the target sheet 202 and target support 226 that a marksman may shoot at as part of their training and marksmanship. The target sheet 202 and/or the target support 226 may be coupled to the arms 208-1, 208-2 via coupling devices 210-1, 210-2 so that the target sheet 202 and the target support 226 may be carried by the target carrier 110. In one example, the coupling devices 210 may include rivets, screws, bolts, nuts, adhesives, magnets, and other types of coupling devices. In one example, the target sheet 202 may be coupled to the target support 226 via the coupling devices 210-1, 210-2 and/or other coupling means such as, for example, office binder clips, paracord, string, tape adhesive, other coupling devices and combinations thereof.

In one example, the target support 226 may be made of cardboard, cardstock, wood, or other material that a bullet shot from a firearm may permeate through. In this example, the target system 100 may be placed in an area where the bullet shot through the target sheet 202 and the target support 226 may be stopped by a backstop such as a bullet trap, a stop-butt, an earth mound, a sandbag barrier or specially designed funnel-shaped traps to catch and prevent misaligned shots, errant projectile ricochets, or shots going beyond the bounds of the shooting range in which the target system 100 is deployed.

In one example, the target support 226 may be made of a metal such as a hardened steel (e.g., AR500 and AR550 steel) so that a bullet shot from a firearm may ricochet off the steel target and down into the earth below the target system 100. For example, the target support 226 may include a gong-style backing that may make a loud sharp sound that is audible from distance once hit by the bullet and may move when hit generally in the direction of the force applied to it by the bullet. In one example, the metal target support 226, popular in action shooting, metallic silhouette, long range shooting and various field target/field shooting disciplines, may include a shape approximating a human, an animal, or other shape.

The housing 212 may contain a number of elements and devices that cause the target carrier 110 to move along a length of the suspension line 102. The housing 212 may include one or more wheels 224-1, 224-2, 224-3, 224-4, 224-N, where N is any integer greater than or equal to 1 (collectively referred to herein as wheel(s) 224 unless specifically addressed otherwise). The wheels 224 may be rotatably coupled to a wall 318 of the housing 212. In one example, the wheels 224 may include an outer surface with a material that has a relatively higher coefficient of friction with respect to some other materials such that the wheels 224, when engaged with or abutting the suspension line 102, may cause the wheels 224 to move with the suspension line 102 and/or may cause a wheel 224 that is driven (e.g., rotated by a mechanical force) to pull the target carrier 110 along the length of the suspension line. In one example, the outer surface of the wheels 224 may include a rubber, a texture, a knurling, or other material or surface that creates the relatively higher coefficient of friction.

The housing 212 may include one or more gears 222 that may be mechanically coupled to one or more of the wheels 224. The gears 222 may drive at least one of the wheels 224. Further, at least one motor 218 may be mechanically coupled to the gears 222 to drive the gears 222 when the motor 218 is activated. In one example, a plurality of motors 218 (e.g., a dual drive system) may be mechanically coupled to the gears 222 to drive the gears 222 and may prove more efficient in examples where heavy steel targets are coupled to the target carrier 110. In one example, activation of the motor 218 may drive the gears 222 which, in turn, drives at least one of the wheels 224. In this manner, the target carrier 110 may be moved along the length of the suspension line 102. In one example, the motor 218 may be able to drive the gears 222 and wheels 224 sufficiently fast enough to cause the target carrier 110 to move between 0 and 50 miles per hour (mph) or higher to allow for the mimicking of movement of a human or animal. In one example, the motor 218 may be able to drive the gears 222 and wheels 224 sufficiently fast enough to cause the target carrier 110 to move between 0 and 20 mph, 0 and 12 mph. 0 and 30 mph, 0 and 45 mph, other ranges of speeds, and combinations thereof. In one example, the motor 218 may be able to drive the gears 222 and wheels 224 at any rate to mimic any object or animal the user is seeking to have the target carrier 110 mimic.

A power source 220 may be included within the housing 212 to power the motor 218. In one example, the power source 220 may include a battery. The battery may include an alkaline battery, a solid-state battery, a non-rechargeable battery, a rechargeable battery, a rechargeable alkaline battery, a lithium-ion battery, a solid state battery, a nickel-cadmium battery, other types of batteries, and combinations thereof. In one example, the power source 220 may include a rechargeable battery allowing a user to periodically plug the target carrier 110 into a power source in order to replenish the charge within the power source.

The housing 212 of the target carrier 110 may further house a controller 216. The controller 216 may include any data processing device such a processor, a central processing unit, a microprocessor, and other data processing devices. The controller 216 may include hardware, software, or a combination thereof. In one example, the controller 216 may include a non-transitory computer-readable medium storing instructions that, when executed, causes the controller 216 to perform operations including activating the motor 218 as described herein. The controller 216 may perform these operations based on pre-programmed data, data defined by user inputs, and combinations thereof. The controller 216 may cause the motor 218 to activate in one or more ways including, for example, rotating in a first direction, rotating in a second direction, stop, pause, delay, reduce speed during rotation, reduce acceleration during rotation, increase speed during rotation, increase acceleration during rotation, rotate randomly, rotate in a pre-defined pattern, and combinations thereof. This causes the target carrier 110 to move along a length of the suspension line through movement of the gears 222, and the wheels 224 as driven by the motor 218, and may cause the target carrier 110 move in a first direction, move in a second direction, stop, pause, delay, reduce speed during movement, reduce acceleration during movement, increase speed during movement, increase acceleration during movement, move randomly, move in a pre-defined pattern, and combinations thereof.

The controller 216 may receive user input via a user interface (not shown) or other means. The user inputs may include instructions as to how the target carrier 110 is to function. More details regarding the function of the controller 216 is described herein in connection with the remote control device 112. The controller 216 may receive instructions via a transceiver 214 housed in the housing 212. The transceiver 214 may receive and transmit data via wireless communication protocol(s) and channel(s). For example, the wireless communication protocol(s) and channel(s) may include radio waves, mobile broadband. Wi-Fi, Bluetooth, near-field communication (NFC), and other forms of wireless communication.

The target carrier 110 may further include a clutch system 320 that may be used to selectively engage and disengage the target carrier 110 to and from the suspension line 102. The clutch system 320 may cause at least one of the wheels 224 to move relative to the suspension line 102 as indicated by arrow 316 in order to cause the at least one wheel 224 to selectively engage and disengage from the suspension line 102. The clutch system 320 may be coupled to at least one wheel 224 via a wheel arm 304-1, 304-2, 304-N, where N is any integer greater than or equal to 1 (collectively referred to herein as wheel arm(s) 304 unless specifically addressed otherwise). The wheel arms 304 may be coupled to an axis of the wheels 224. Each wheel arm 304 may be coupled to a wheel bar 306. The wheel bar 306 may be coupled to a lever 312 via a lever arm 310. Further, the clutch system 320 may include a spring 308 interposed between the housing 212 and the wheel bar 306. The spring 308 may be biased to force the wheels 224 toward the suspension line 102 via the wheel bar 306 and wheel arm(s) 304. The spring 308 of the clutch system 320 causes the wheels 224 located above the suspension line 102 (e.g., wheels 224-1, 224-3, 224-N) to apply pressure against the suspension line in opposition to wheels 224 located below the suspension line 102 (e.g., wheels 224-2, 224-4). This, in turn, causes the coefficient of friction between the wheels 224 and the suspension line 102 to increase such that when at least one of the wheels 224 is driven by the motor 218 via the gears 222, the target carrier 110 may move along the length of the suspension line 102.

In one example such as the example of FIGS. 2 and 3, the wheels 224 located above the suspension line 102 (e.g., wheels 224-1, 224-3, 224-N) may be coupled to the housing 212 via the clutch system 320 with the clutch system 320 being held in position by the housing 212. Further, in one example, the wheels 224 located above the suspension line 102 (e.g., wheels 224-1, 224-3, 224-N) may not be coupled to the gears 222 and may be free rotating so that the wheel arms 304 can couple to an axis of the wheels 224 located above the suspension line 102 (e.g., wheels 224-1, 224-3, 224-N). At least one of the wheels 224 located below the suspension line 102 (e.g., wheels 224-2, 224-4) may be mechanically coupled to the gears 222 to provide the driving force provided by the motor 218. Further, the wheels 224 located below the suspension line 102 (e.g., wheels 224-2, 224-4) may be rotatably coupled to the wall 318 of the housing 212 via an axis of the wheels 224 such that the wheels 224 located below the suspension line 102 (e.g., wheels 224-2, 224-4) are stationary and provide a buttress against which the wheels 224 located above the suspension line 102 (e.g., wheels 224-1, 224-3, 224-N) may apply pressure.

In contrast, in one example such as the example of FIGS. 2 and 3, the wheels 224 located below the suspension line 102 (e.g., wheels 224-2, 224-4) may be coupled to the housing 212 via the clutch system 320 with the clutch system 320 being held in position by the housing 212. Further, in one example, the wheels 224 located below the suspension line 102 (e.g., wheels 224-2, 224-4) may not be coupled to the gears 222 and may be free rotating so that the wheel arms 304 can couple to an axis of the wheels 224 located below the suspension line 102 (e.g., wheels 224-2, 224-4). At least one of the wheels 224 located above the suspension line 102 (e.g., wheels 224-1, 224-3, 224-N) may be mechanically coupled to the gears 222 to provide the driving force provided by the motor 218. Further, the wheels 224 located above the suspension line 102 (e.g., wheels 224-1, 224-3, 224-N) may be rotatably coupled to the wall 318 of the housing 212 via an axis of the wheels 224 such that the wheels 224 located above the suspension line 102 (e.g., wheels 224-1, 224-3, 224-N) are stationary and provide a buttress against which the wheels 224 located below the suspension line 102 (e.g., wheels 224-2, 224-4) may apply pressure.

In one example, one or more of the wheels located above the suspension line 102 (e.g., wheels 224-1, 224-3, 224-N and one or more of the wheels located below the suspension line 102 (e.g., 224-2, 224-4) may be coupled to the housing 212 via the clutch system 320 with the clutch system 320 being held in position by the housing 212. Further, in one example, one or more of the wheels located above the suspension line 102 (e.g. wheels 224-1, 224-3, 224-N and one or more of the wheel located below the suspension line 102 (e.g., 224-2, 224-4) may be coupled to the gears 222 and/or may be free rotating so that the wheel arms 304 can couple to an axis of the wheels 224. Further, one or more of the wheels located above the suspension line 102 (e.g. wheels 224-1, 224-3, 224-N and one or more of the wheel located below the suspension line 102 (e.g., 224-2, 224-4) may be mechanically coupled to the gears 222 to provide the driving force provided by the motor 218. Further, one or more of the wheels located above the suspension line 102 (e.g. wheels 224-1, 224-3, 224-N and one or more of the wheel located below the suspension line 102 (e.g., 224-2, 224-4) may be rotatably coupled to the wall 318 of the housing 212 via an axis of the wheels 224 such that one or more of the wheels located above the suspension line 102 (e.g. wheels 224-1, 224-3, 224-N and one or more of the wheel located below the suspension line 102 (e.g., 224-2, 224-4) are stationary and provide a buttress against which one or more of the wheels located above the suspension line 102 (e.g. wheels 224-1, 224-3, 224-N and one or more of the wheel located below the suspension line 102 (e.g., 224-2, 224-4) may apply pressure.

In one example, the wheels 224 located above the suspension line 102 (e.g., wheels 224-1, 224-3, 224-N) and the wheels 224 located below the suspension line 102 (e.g., wheels 224-2, 224-4) may be offset with respect to one another such that a wheel 224 located below the suspension line 102 (e.g., wheels 224-2, 224-4) is horizontally aligned between two wheels 224 located above the suspension line 102 (e.g., wheels 224-1, 224-3, 224-N) and vice versa. This may allow the wheels 224 to place pressure on the suspension line 102 across a relatively longer length of the suspension line 102.

The clutch system 320 may cause at least one of the wheels 224 to disengage with the suspension line 102 by applying pressure to the lever 312. An aperture 302 may be defined in a back side 322 of the housing 212. Specifically, the aperture 302 may be defined in a first side 322 of the housing 212 and at least partially in a first adjacent side 324 and a second adjacent side 326 in order to accommodate for the suspension line 102 entering the housing 212 and engaging with the wheels 224. Applying pressure to the lever 312 in the direction of arrow 314 for example, may cause the bias of the spring 308 to be overcome resulting in the movement of the wheels 224 located above the suspension line 102 (e.g., wheels 224-1, 224-3, 224-N) away from the suspension line 102 and the wheels 224 located below the suspension line 102 (e.g., wheels 224-2, 224-4). In this state, the suspension line 102 may be removed from engagement with the wheels 224 and the housing 212 via the aperture 302. Removing the pressure on the lever 312 may cause the bias of the spring 308 to push the wheels 224 located above the suspension line 102 (e.g., wheels 224-1, 224-3, 224-N) toward the wheels 224 located below the suspension line 102 (e.g., wheels 224-2, 224-4). The suspension line 102 may be re-engaged with the wheels 224 and the housing 212 by the method above in the reverse order. In this manner, in one example, the target carrier 110 may engage and disengaged with the suspension line 102. However, any engagement and disengagement device and method may be utilized to selectively engage and disengage the target carrier 110 to and from the suspension line 102.

In one example, the target carrier 110 may further include a number of sensor(s) 228. The sensor(s) 228 may be communicatively coupled to the controller 216. Further, the sensor(s) 228 may be configured to detect any environmental aspect internal or external to the target carrier 110. The sensor(s) may include, for example, acoustic sensors, sound sensors, vibration sensors, automotive sensors, chemical sensors, electric current sensors, electrical potential sensors, magnetic sensors, radio sensors, weather sensors, moisture sensors, humidity sensors, fluid flow sensors, fluid velocity sensors, ionizing radiation sensors, subatomic particle sensors, navigational sensors, position sensors, angle sensors, displacement sensors, distance sensors, speed sensors, acceleration sensors, optical sensors, light sensors, imaging sensors, photon sensors, pressure sensors, force sensors, density sensors, level sensors, thermal sensors, heat sensors, temperature sensors, proximity sensors, presence sensors, other types of sensors, and combinations thereof.

In one example, the sensor(s) 228 may be integrated into the target carrier 110 in order to identify the various functions of the target carrier 110. For example, the sensor(s) may include motion sensors such as, for example, a passive infrared (P/IR) sensor or an ultrasonic sensor that may detect the movement of a user or other object within the field of view of the sensor. In this example, the P/IR sensor may be used to activate or "trip" the target carrier 110 and, more specifically, activate the controller 216 to cause the target carrier 110 to move in at least one direction along the suspension line 102 and/or move based on programmed movement instructions as described herein. This allows a user to, for example, enter an environment or proximity of the target carrier 110 and mimic the movement of an animal or human to provide as realistic a firearm scenario as possible. In one example, the sensor(s) may include force sensors such as, for example, a pressure plates that may detect the impingement of a force (e.g., a touch of a user or a bullet shot from a firearm. In this example, the force sensor may similarly be used to activate or "trip" the target carrier 110 and, more specifically, activate the controller 216 to cause the target carrier 110 to move in at least one direction along the suspension line 102 and/or move based on programmed movement instructions as described herein. Any type of sensor 228 may be used to detect any type of a change in the environment of the target carrier 110 to trigger the activation of the target carrier 110.

In one example, the sensor(s) 228 may be used to trigger any function of the target carrier 110 including the ceasing of one or more functions. For example, a sensor such as a proximity sensor may be used to detect when the target carrier 110 is approaching and/or at a position along the suspension line 102 and trigger the target carrier 110 to stop movement along the suspension line 102. In one example, the position along the suspension line 102 at which the target carrier 110 is to stop may include, for example, an end of the suspension line 102 allowing the target carrier 110 to avoid hitting the trees 104-1, 104-2 for example.

Although the target carrier 110 described herein is described as including wheels 224, gears 222, a clutch system 320, tensioners, any devices or combinations of devices may be used to move the target carrier 110 along the length of the suspension line 102. For example, the target carrier may be belt-driven, wormgear-driven, or otherwise driven by other types of devices and systems.

Figure 4:
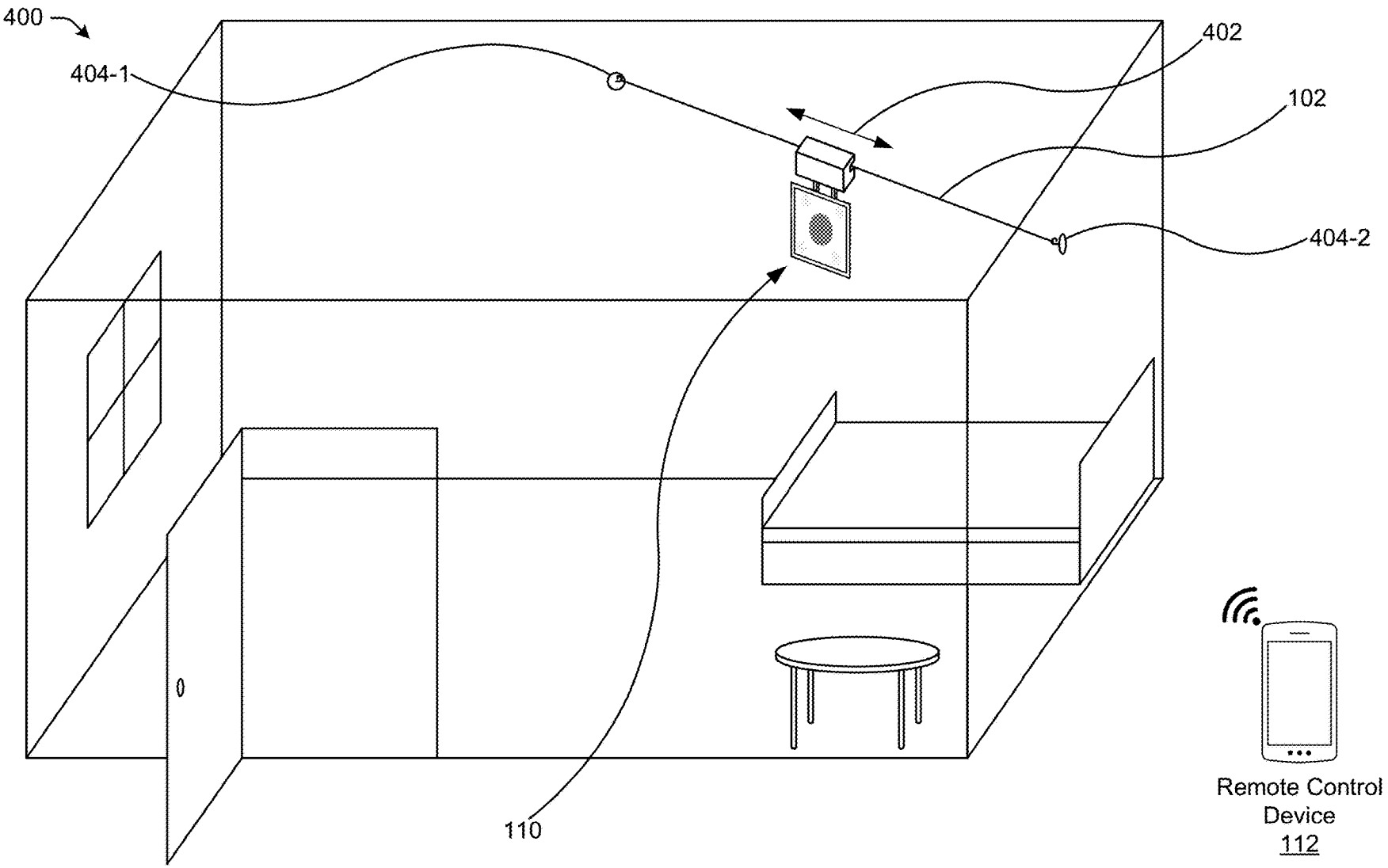
FIG. 4 illustrates a system diagram of a target system, according to an example of the principles described herein.

FIG. 4 illustrates a system diagram of a target system 400, according to an example of the principles described herein. In the example of FIG. 4, the target system 400 may be deployed within an indoor setting such as, for example, a tactical shoot house where a marksman may utilize the target carrier 110 and suspension line 102 to assist in training in such an environment. The target system 400 of FIG. 4 may include a first wall coupling device 404-1 and a second wall coupling device 404-2 that may be used to couple the suspension line 102 to the walls of the indoor setting of the target system 400. In one example, the first wall coupling device 404-1 and the second wall coupling device 404-2 may include a hook, a hanger, a bracket, an eye strap, an eye hook, a quick connector, a spring hook, a fender hook, a fender lock, a carabiner, a ring hook, a D-ring hanger, other types of wall mounting devices, and combinations thereof. In one example, the suspension line 102 may be coupled to the first wall coupling device 404-1 and a second wall coupling device 404-2 via a pair of coupling devices such as the coupling devices 108-1, 108-2 (e.g., a carabiner or similar device) as depicted in FIG. 1. Further, in one example, the suspension line 102 may include a ratchet (not shown) to allow a user to selectively slacken or tighten the suspension line 102 to allow for varied tensions on the first wall coupling device 404-1 and a second wall coupling device 404-2 and the suspension line 102. Once coupled to the walls of the indoor setting of the target system 400, the target carrier 110 may be coupled to the suspension line 102 and may be activated to move in the direction of arrow 402 as described herein.

Figure 5:
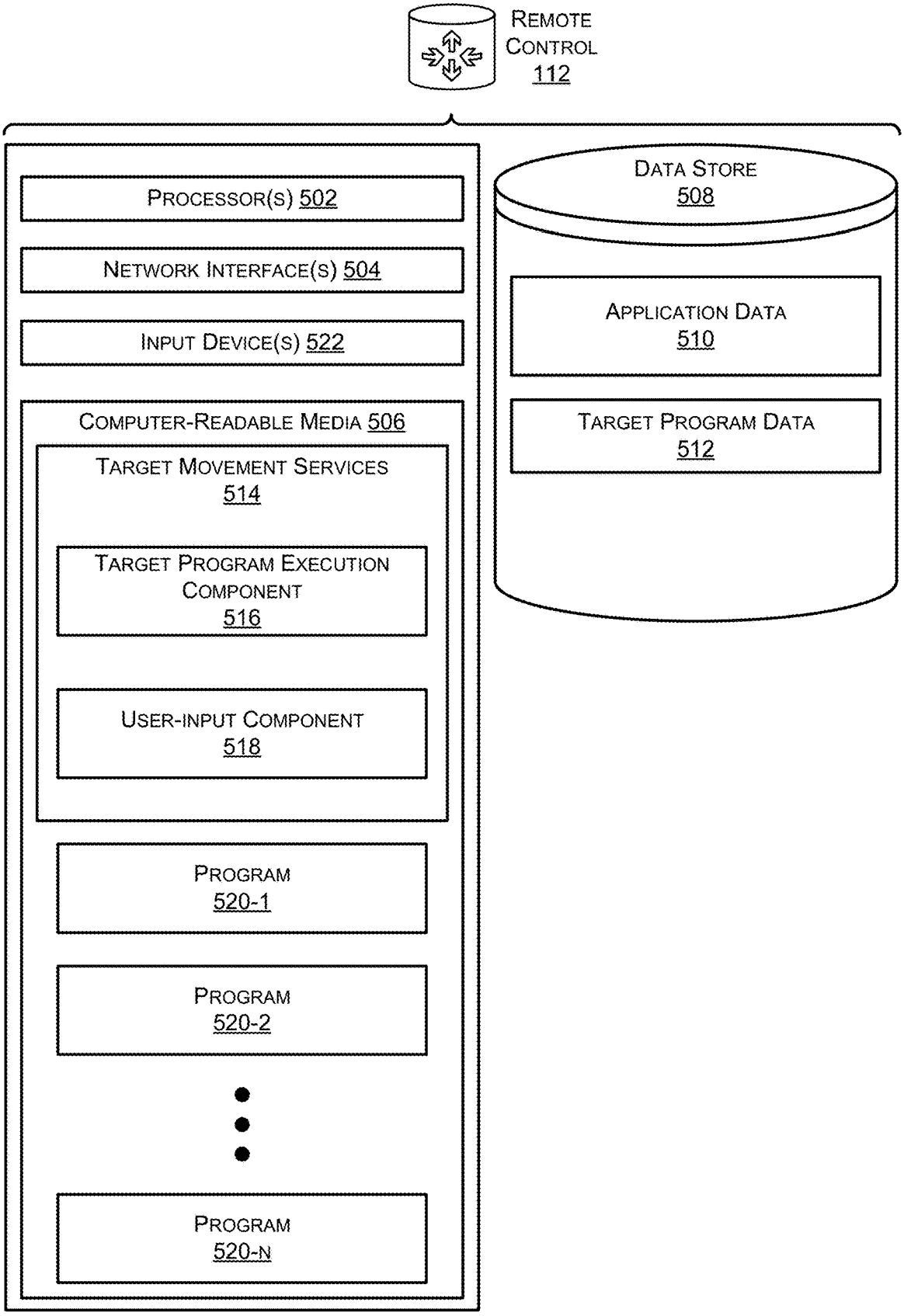
FIG. 5 is a component diagram of example components of a remote control device for the target carrier of FIGS. 1 and 4, according to an example of the principles described herein.

As depicted in FIG. 4, a remote control device 112 may be included as part of the target system 400 in a manner similar to the remote control device 112 included in the target system 100 of FIG. 1. FIG. 5 is a component diagram of example components of a remote control device 112 for the target carrier 110 of FIGS. 1 and 4, according to an example of the principles described herein. As illustrated, the remote control device 112 may include one or more hardware processor(s) 502 configured to execute one or more stored instructions. The processor(s) 502 may comprise one or more cores. Further, the remote control device 112 may include one or more network interfaces 504 configured to provide communications between the remote control device 112 and other devices, such as devices associated with target carrier 110 of FIGS. 1 through 4 including the controller 216 and transceiver 214, and/or other systems or devices associated with the remote control device 112 and/or remote from the remote control device 112. The network interfaces 504 may include devices configured to couple to personal area networks (PANs), wired and wireless local area networks (LANs), wired and wireless wide area networks (WANs), and so forth. For example, the network interfaces 504 may include devices compatible with the controller 216 and transceiver 214 and/or other systems or devices associated with the remote control device 112.

The remote control 112 may further include one or more input device(s) 522. The input device(s) 522 may include a keyboard, a touch screen including user interaction graphics, a mouse, a scanner, a camera, a joystick, a microphone, other user input devices, the sensor(s) 228 of FIG. 2, other input devices, and combinations thereof. In this manner, a user or devices such as the sensor(s) 228 may be used as input to provide instructions to the remote control 112 and, in turn, control the functions of the target carrier 110 as described herein.

The remote control device 112 may also include computer-readable media 506 that stores various executable components (e.g., software-based components, firmware-based components, etc.). In one example, the computer-readable media 506 may include, for example, working memory, random access memory (RAM), read only memory (ROM), and other forms of persistent, non-persistent, volatile, non-volatile, and other types of data storage. In addition to various components discussed herein, the computer-readable media 506 may further store components to implement functionality described herein. While not illustrated, the computer-readable media 506 may store one or more operating systems utilized to control the operation of the one or more devices that comprise the remote control device 112 and or the target carrier 110. According to one example, the operating system comprises the LINUX operating system. According to another example, the operating system(s) comprise the WINDOWS® SERVER operating system from MICROSOFT Corporation of Redmond, Washington. According to further examples, the operating system(s) may comprise the UNIX operating system or one of its variants. It may be appreciated that other operating systems may also be utilized. In one example, the operating system(s) may include an Internet of Things (IoT) supported operating system developed and distributed by MICROSOFT, LINUX, UNIX, or other operating system provider.

Additionally, the remote control device 112 may include a data store 508 which may comprise one, or multiple, repositories or other storage locations for persistently storing and managing collections of data such as databases, simple files, binary, and/or any other data. The data store 508 may include one or more storage locations that may be managed by one or more database management systems. The data store 508 may store, for example, application data 510 defining computer-executable code utilized by the processor 502 to execute the target movement services 514. Further, the application data 510 may include data relating to user preferences associated with the target movement services 514, and other data that may be used by the target movement services 514 to instruct the target carrier 110 to move along a length of the suspension line 102.

Further, the data store 508 may store target program data 512. The target program data 512 may include any data or instructions obtained or transmitted by the remote control device 112 and/or the controller 216 regarding the manner in which the target carrier 110 is to operate. This target program data 512 may include, for example, data or instructions defining operation or activation of the motor 218. For example, target program data 512 may include instructions to the controller 216 and/or the motor 218 to activate in one or more ways including, for example, rotating in a first direction, rotating in a second direction, stop, pause, delay, reduce speed during rotation, reduce acceleration during rotation, increase speed during rotation, increase acceleration during rotation, rotate randomly, rotate in a pre-defined pattern, and combinations thereof. This, in turn, causes the target carrier 110 to move along the suspension line 102 in a corresponding manner. The target program data 512 may be utilized in connection with the application data to define such movements and activations. In one example, one or more programs 520-1, 520-2, 520-N, where N is any integer greater than or equal to 1 (collectively referred to herein as program(s) 520 unless specifically addressed otherwise) may be defined by the application data 510 and/or the target program data 512. The programs 520 may define different sets of instructions to the controller 216 and/or the motor 218 to operate or activate in a pre-defined manner. For example, a first program 520-1 may define instructions to the controller 216 and/or the motor 218 to operate or activate in a pre-defined manner that mimics the movement of a human or animal including an initial startled movement and a movement mimicking a fight or flight response where the human or animal responds to a perceived harmful event, attack, or threat to survival. In this manner, the first program 520-1 may simulate a real-life policing or hunting scenario. In one example, the programs 520 may be user-defined such that any and all movement of the target carrier 110 along the suspension line 102 may be defined by the user entering instructions defining the program 520.

The computer-readable media 506 may store portions, or components, of target movement services 514. For instance, the target movement services 514 of the computer-readable media 506 may include a target program execution component 516 to, when executed by the processor(s) 502 and controller 216, execute one or more of the programs 520. The target program execution component 516 may also send instructions to the controller 216 via the network interface(s) 504 and the transceiver 214 that define the one or more programs 520 in order to cause the target carrier 110 to move according to the program 520. The target program execution component 516 may include all or a portion of the executable code associated with the target carrier 110 and may be executed to bring about the functionality of the target carrier 110 as described herein.

The computer-readable media 506 may also include a user-input component 518. The user-input component 518 may receive user inputs from user input devices (not show) such as, for example, a keyboard, a touch screen including user interaction graphics, a mouse, a scanner, a camera, a joystick, a microphone, other user input devices, and combinations thereof. Input received from the user-input component 518 may include and be translated into instructions as to how the target carrier 110 is to function. Thus, the user-input component 518, when executed by the processor(s) 502, may receive user input from a user, translate the user input into instructions, and transmit those instructions to the transceiver 214 and controller 216 to cause the target carrier 110 to function based on those instructions.

In one example, the target movement services 514 may be provided in the form of an app or application executed on a smartphone or similar mobile device. The smartphone application may be provided via an online app store, for example, that the user may download and install on their smartphone or other mobile device. In this manner, the target carrier 110 may be operated remotely via an application executed on a smartphone.

Figure 6:
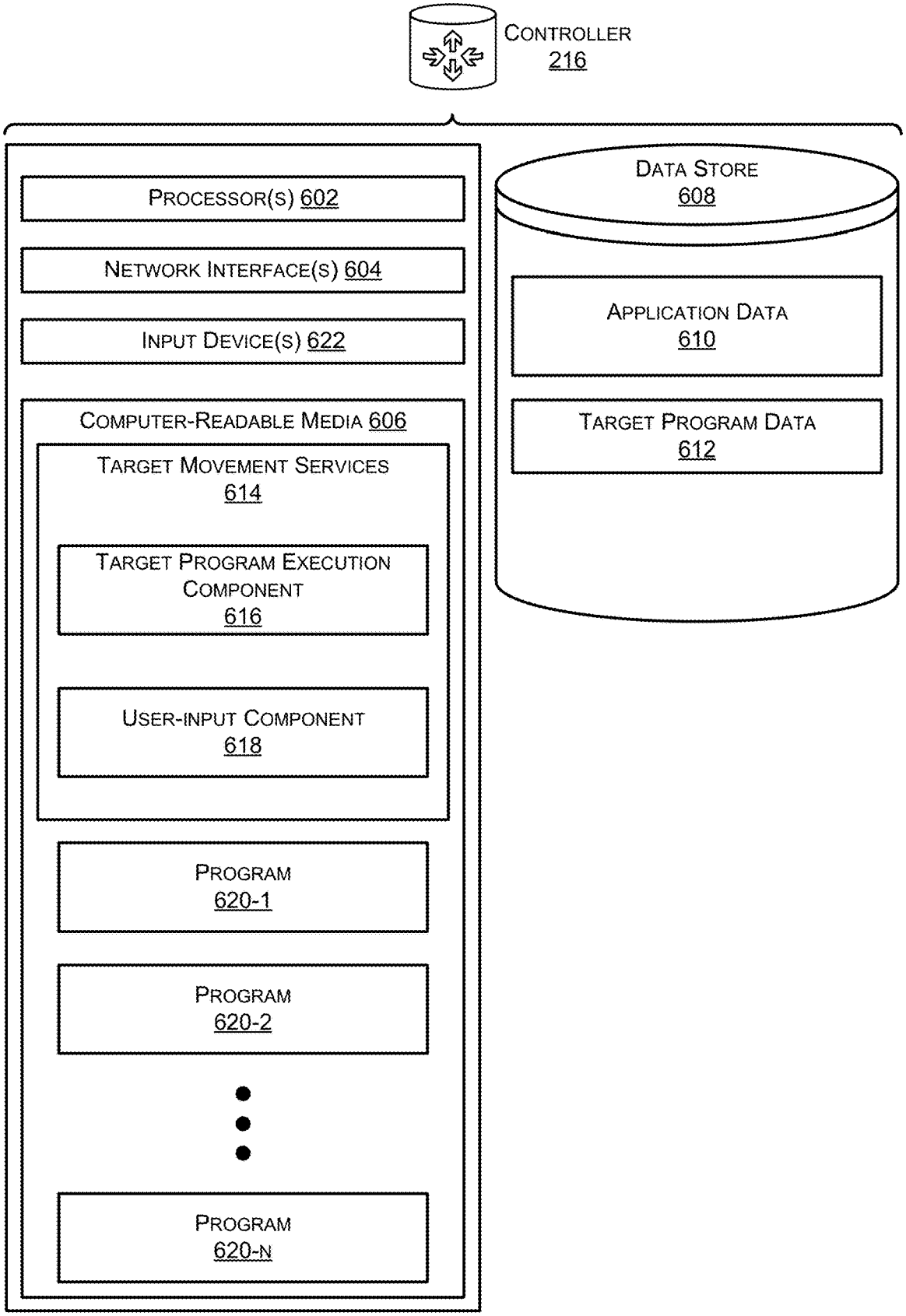
FIG. 6 is a component diagram of example components of a controller of the target carrier of FIGS. 1 and 4, according to an example of the principles described herein.

FIG. 6 is a component diagram of example components of a controller 216 of the target carrier 110 of FIGS. 1 and 4, according to an example of the principles described herein. Description of the controller 216 is provided herein. However, the controller 216 may include a far more inclusive device as depicted in FIG. 6.

FIG. 6 is a component diagram of example components of a controller of the target carrier of FIGS. 1 and 4, according to an example of the principles described herein. As illustrated, the controller 216 may include one or more hardware processor(s) 602 configured to execute one or more stored instructions. The processor(s) 602 may comprise one or more cores. Further, the controller 216 may include one or more network interfaces 604 configured to provide communications between the controller 216 and other devices, such as devices associated with the remote control device 112 of FIGS. 1 through 5 and/or other systems or devices associated with the controller 216 and/or remote from the controller 216. The network interfaces 604 may include devices configured to couple to personal area networks (PANs), wired and wireless local area networks (LANs), wired and wireless wide area networks (WANs), and so forth. For example, the network interfaces 604 may include devices compatible with the controller 216 and/or other systems or devices associated with the controller 216. In one example, the network interface(s) 604 may include the transceiver 214.

The controller 216 may further include one or more input device(s) 622. The input device(s) 622 may include a keyboard, a touch screen including user interaction graphics, a mouse, a scanner, a camera, a joystick, a microphone, other user input devices, the sensor(s) 228 of FIG. 2, other input devices, and combinations thereof. In this manner, a user or devices such as the sensor(s) 228 may be used as input to provide instructions to the controller 216 and, in turn, control the functions of the target carrier 110 as described herein.

The controller 216 may also include computer-readable media 606 that stores various executable components (e.g., software-based components, firmware-based components, etc.). In one example, the computer-readable media 606 may include, for example, working memory, random access memory (RAM), read only memory (ROM), and other forms of persistent, non-persistent, volatile, non-volatile, and other types of data storage. In addition to various components discussed herein, the computer-readable media 606 may further store components to implement functionality described herein. While not illustrated, the computer-readable media 606 may store one or more operating systems utilized to control the operation of the one or more devices that comprise the controller 216. According to one example, the operating system comprises the LINUX operating system. According to another example, the operating system(s) comprise the WINDOWS® SERVER operating system from MICROSOFT Corporation of Redmond, Washington. According to further examples, the operating system(s) may comprise the UNIX operating system or one of its variants. It may be appreciated that other operating systems may also be utilized. In one example, the operating system(s) may include an Internet of Things (IOT) supported operating system developed and distributed by MICROSOFT, LINUX, UNIX, or other operating system provider.

Additionally, the controller 216 may include a data store 608 which may comprise one, or multiple, repositories or other storage locations for persistently storing and managing collections of data such as databases, simple files, binary, and/or any other data. The data store 608 may include one or more storage locations that may be managed by one or more database management systems. The data store 608 may store, for example, application data 610 defining computer-executable code utilized by the processor 602 to execute the target movement services 614. Further, the application data 610 may include data relating to user preferences associated with the target movement services 614, and other data that may be used by the target movement services 614 to instruct the target carrier 110 to move along a length of the suspension line 102.

Further, the data store 608 may store target program data 612. The target program data 612 may include any data or instructions obtained or transmitted by the network interface(s) 604 (e.g., the transceiver 214) and/or the remote control device 112 regarding the manner in which the target carrier 110 is to operate. This target program data 612 may include, for example, data or instructions defining operation or activation of the motor 218. For example, target program data 612 may include instructions to the controller 216 and/or the motor 218 to activate in one or more ways including, for example, rotating in a first direction, rotating in a second direction, stop, pause, delay, reduce speed during rotation, reduce acceleration during rotation, increase speed during rotation, increase acceleration during rotation, rotate randomly, rotate in a pre-defined pattern, and combinations thereof. This, in turn, causes the target carrier 110 to move along the suspension line 102 in a corresponding manner. The target program data 612 may be utilized in connection with the application data to define such movements and activations. In one example, one or more programs 620-1, 620-2, 620-N, where N is any integer greater than or equal to 1 (collectively referred to herein as program(s) 620 unless specifically addressed otherwise) may be defined by the application data 610 and/or the target program data 612. The programs 620 may define different sets of instructions to the controller 216 and/or the motor 218 to operate or activate in a pre-defined manner. For example, a first program 620-1 may define instructions to the controller 216 and/or the motor 218 to operate or activate in a pre-defined manner that mimics the movement of a human or animal including an initial startled movement and a movement mimicking a fight or flight response where the human or animal responds to a perceived harmful event, attack, or threat to survival. In this manner, the first program 620-1 may simulate a real-life policing or hunting scenario. In one example, the programs 620 may be user-defined such that any and all movement of the target carrier 110 along the suspension line 102 may be defined by the user entering instructions defining the program 620.

The computer-readable media 606 may store portions, or components, of target movement services 614. For instance, the target movement services 614 of the computer-readable media 606 may include a target program execution component 616 to, when executed by the processor(s) 602 and controller 216, execute one or more of the programs 620. The target program execution component 616 may also send instructions to the controller 216 via the network interface(s) 604 and the transceiver 214 as well as the remote control device 112 that define the one or more programs 620 in order to cause the target carrier 110 to move according to the program 620. The target program execution component 616 may include all or a portion of the executable code associated with the target carrier 110 and may be executed to bring about the functionality of the target carrier 110 as described herein.

The computer-readable media 606 may also include a user-input component 618. The user-input component 618 may receive user inputs from user input devices (not shown) such as, for example, a keyboard, a touch screen including user interaction graphics, a mouse, a scanner, a camera, a joystick, a microphone, other user input devices, and combinations thereof. Input received from the user-input component 618 may include and be translated into instructions as to how the target carrier 110 is to function. Thus, the user-input component 618, when executed by the processor (s) 602, may receive user input from a user, translate those inputs into instructions, and transmit those instructions to controller 216 to cause the target carrier 110 to function based on those instructions.

Figure 7:
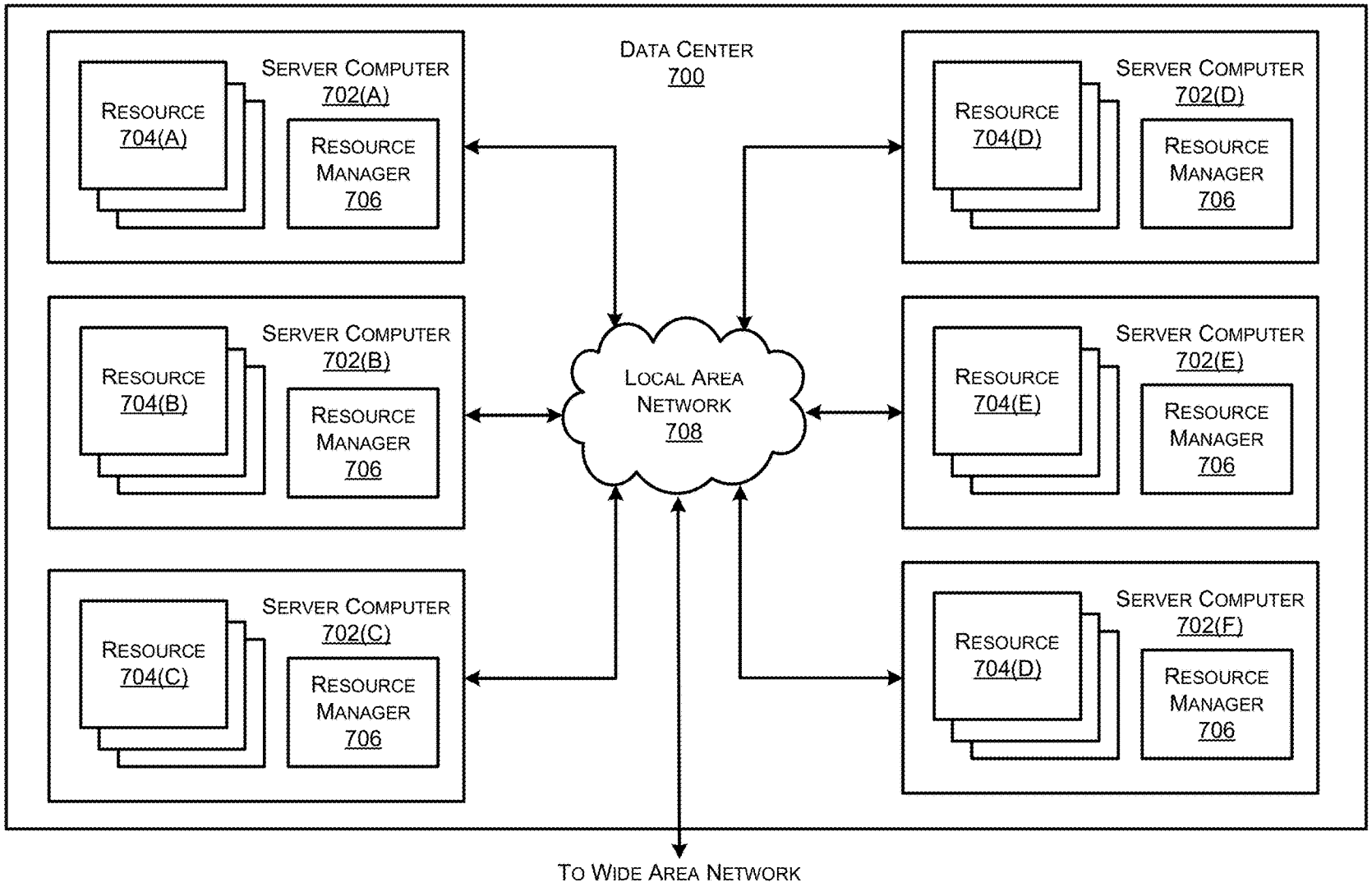
FIG. 7 illustrates a computing system diagram illustrating a configuration for a data center that may be utilized to implement aspects of the technologies disclosed herein.

FIG. 7 illustrates a computing system diagram illustrating a configuration for a data center 700 that may be utilized to implement aspects of the technologies disclosed herein. The example data center 700 shown in FIG. 7 includes several server computers 702A-702F (which might be referred to herein singularly as "a server computer 702" or in the plural as "the server computers 702") for providing computing resources. In some examples, the resources and/or server computers 702 may include, or correspond to, any type of networked device described herein. Although described as servers, the server computers 702 may comprise any type of networked device, such as servers, switches, routers, hubs, bridges, gateways, modems, repeaters, access points, etc.

The server computers 702 may be standard tower, rack-mount, or blade server computers configured appropriately for providing computing resources. In some examples, the server computers 702 may provide computing resources 704 including data processing resources such as VM instances or hardware computing systems, database clusters, computing clusters, storage clusters, data storage resources, database resources, networking resources, virtual private networks (VPNs), and others. Some of the server computers 702 may also be configured to execute a resource manager 706 capable of instantiating and/or managing the computing resources. In the case of VM instances, for example, the resource manager 706 may be a hypervisor or another type of program configured to enable the execution of multiple VM instances on a single server computer 702. Server computers 702 in the data center 700 may also be configured to provide network services and other types of services.

In the example data center 700 shown in FIG. 7, an appropriate LAN 708 is also utilized to interconnect the server computers 702A-702F. It may be appreciated that the configuration and network topology described herein has been greatly simplified and that many more computing systems, software components, networks, and networking devices may be utilized to interconnect the various computing systems disclosed herein and to provide the functionality described above. Appropriate load balancing devices or other types of network infrastructure components may also be utilized for balancing a load between data centers 700, between each of the server computers 702A-702F in each data center 700, and, potentially, between computing resources in each of the server computers 702. It may be appreciated that the configuration of the data center 700 described with reference to FIG. 7 is merely illustrative and that other implementations may be utilized.

In some examples, the server computers 702 and or the computing resources 704 may each execute/host one or more tenant containers and/or virtual machines to perform techniques described herein.

In some instances, the data center 700 may provide computing resources, like tenant containers, VM instances, VPN instances, and storage, on a permanent or an as-needed basis. Among other types of functionality, the computing resources provided by a cloud computing network may be utilized to implement the various services and techniques described herein. The computing resources 704 provided by the cloud computing network may include various types of computing resources, such as data processing resources like tenant containers and VM instances, data storage resources, networking resources, data communication resources, network services, VPN instances, and the like.

Each type of computing resource 704 provided by the cloud computing network may be general-purpose or may be available in a number of specific configurations. For example, data processing resources may be available as physical computers or VM instances in a number of different configurations. The VM instances may be configured to execute applications, including web servers, application servers, media servers, database servers, some or all of the network services described above, and/or other types of programs. Data storage resources may include file storage devices, block storage devices, and the like. The cloud computing network may also be configured to provide other types of computing resources 704 not mentioned specifically herein.

The computing resources 704 provided by a cloud computing network may be enabled in one example by one or more data centers 700 (which might be referred to herein singularly as "a data center 700" or in the plural as "the data centers 700"). The data centers 700 are facilities utilized to house and operate computer systems and associated components. The data centers 700 typically include redundant and backup power, communications, cooling, and security systems. The data centers 700 may also be located in geographically disparate locations. One illustrative example for a data center 700 that may be utilized to implement the technologies disclosed herein is described herein with regard to, for example, FIGS. 1 through 6.

Figure 8:
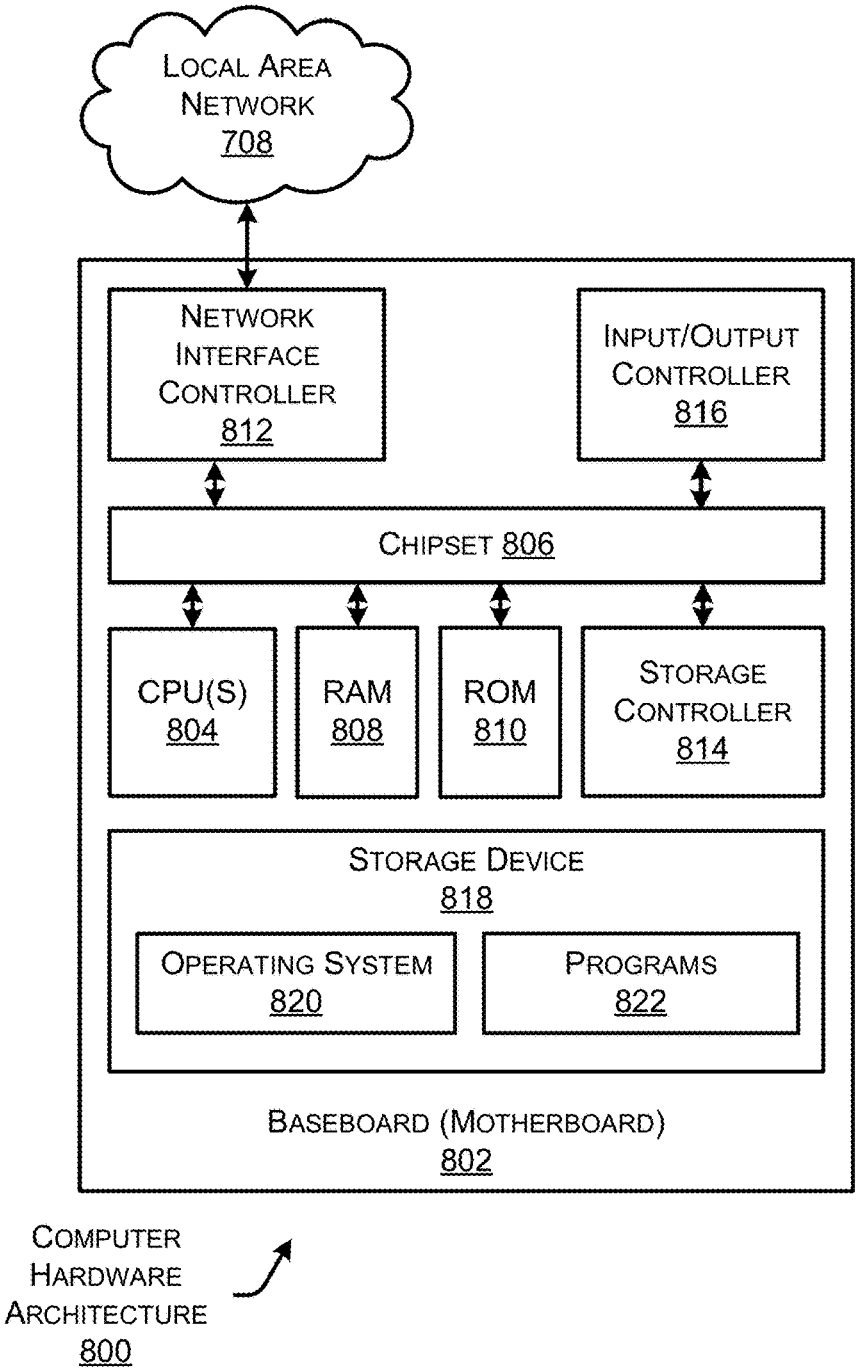
FIG. 8 illustrates a computer architecture diagram showing an example computer hardware architecture for implementing a computing device that may be utilized to implement aspects of the various technologies presented herein.

FIG. 8 illustrates a computer architecture diagram showing an example computer hardware architecture 800 for implementing a computing device that may be utilized to implement aspects of the various technologies presented herein. The computer hardware architecture 800 shown in FIG. 8 illustrates the target carrier 110, the remote control device 112, and/or other systems or devices associated with the target carrier 110 and the remote control device 112 and/or remote from the target carrier 110 and the remote control device 112, a workstation, a desktop computer, a laptop, a tablet, a network appliance, an e-reader, a smartphone, or other computing device, and may be utilized to execute any of the software components described herein. The computer 800 may, in some examples, correspond to a network device (e.g., the target carrier 110 and the remote control device 112, and associated devices) described herein, and may comprise networked devices such as servers, switches, routers, hubs, bridges, gateways, modems, repeaters, access points, etc.

The computer 800 includes a baseboard 802, or "motherboard," which is a printed circuit board to which a multitude of components or devices may be connected by way of a system bus or other electrical communication paths. In one illustrative configuration, one or more central processing units (CPUs) 804 operate in conjunction with a chipset 806. The CPUs 804 may be standard programmable processors that perform arithmetic and logical operations necessary for the operation of the computer 800.

The CPUs 804 perform operations by transitioning from one discrete, physical state to the next through the manipulation of switching elements that differentiate between and change these states. Switching elements generally include electronic circuits that maintain one of two binary states, such as flip-flops, and electronic circuits that provide an output state based on the logical combination of the states of one or more other switching elements, such as logic gates. These basic switching elements may be combined to create more complex logic circuits, including registers, adders-subtractors, arithmetic logic units, floating-point units, and the like.

The chipset 806 provides an interface between the CPUs 804 and the remainder of the components and devices on the baseboard 802. The chipset 806 may provide an interface to a RAM 808, used as the main memory in the computer 800.

The chipset 806 may further provide an interface to a computer-readable storage medium such as a read-only memory (ROM) 810 or non-volatile RAM (NVRAM) for storing basic routines that help to startup the computer 800 and to transfer information between the various components and devices. The ROM 810 or NVRAM may also store other software components necessary for the operation of the computer 800 in accordance with the configurations described herein.

The computer 800 may operate in a networked environment using logical connections to remote computing devices and computer systems through a network, such as the target carrier 110 and the remote control device 112, among other devices. The chipset 806 may include functionality for providing network connectivity through a Network Interface Controller (NIC) 812, such as a gigabit Ethernet adapter. The NIC 812 is capable of connecting the computer 800 to other computing devices within the target systems 100, 400 and external to the target systems 100, 400. It may be appreciated that multiple NICs 812 may be present in the computer 800, connecting the computer to other types of networks and remote computer systems. In some examples, the NIC 812 may be configured to perform at least some of the techniques described herein, such as packet redirects and/or other techniques described herein.

The computer 800 may be connected to a storage device 818 that provides non-volatile storage for the computer. The storage device 818 may store an operating system 820, programs 822 (e.g., any computer-readable and/or computer-executable code described herein), and data, which have been described in greater detail herein. The storage device 818 may be connected to the computer 800 through a storage controller 814 connected to the chipset 806. The storage device 818 may consist of one or more physical storage units. The storage controller 814 may interface with the physical storage units through a serial attached SCSI (SAS) interface, a serial advanced technology attachment (SATA) interface, a fiber channel (FC) interface, or other type of interface for physically connecting and transferring data between computers and physical storage units.

The computer 800 may store data on the storage device 818 by transforming the physical state of the physical storage units to reflect the information being stored. The specific transformation of physical state may depend on various factors, in different examples of this description. Examples of such factors may include, but are not limited to, the technology used to implement the physical storage units, whether the storage device 818 is characterized as primary or secondary storage, and the like.

For example, the computer 800 may store information to the storage device 818 by issuing instructions through the storage controller 814 to alter the magnetic characteristics of a particular location within a magnetic disk drive unit, the reflective or refractive characteristics of a particular location in an optical storage unit, or the electrical characteristics of a particular capacitor, transistor, or other discrete component in a solid-state storage unit. Other transformations of physical media are possible without departing from the scope and spirit of the present description, with the foregoing examples provided only to facilitate this description. The computer 800 may further read information from the storage device 818 by detecting the physical states or characteristics of one or more particular locations within the physical storage units.

In addition to the storage device 818 described above, the computer 800 may have access to other computer-readable storage media to store and retrieve information, such as program modules, data structures, or other data. It may be appreciated by those skilled in the art that computer-readable storage media is any available media that provides for the non-transitory storage of data and that may be accessed by the computer 800. In some examples, the operations performed by the target carrier 110 and the remote control device 112, and or any components included therein, may be supported by one or more devices similar to computer 800. Stated otherwise, some or all of the operations performed by the target carrier 110 and the remote control device 112, and or any components included therein, may be performed by one or more computer devices operating in a cloud-based arrangement.

By way of example, and not limitation, computer-readable storage media may include volatile and non-volatile, removable and non-removable media implemented in any method or technology. Computer-readable storage media includes, but is not limited to, RAM, ROM, erasable programmable ROM (EPROM), electrically-erasable programmable ROM (EEPROM), flash memory or other solid-state memory technology, compact disc ROM (CD-ROM), digital versatile disk (DVD), high definition DVD (HD-DVD), BLU-RAY, or other optical storage, magnetic cassettes, magnetic tape, magnetic disk storage or other magnetic storage devices, or any other medium that may be used to store the desired information in a non-transitory fashion.

As mentioned briefly above, the storage device 818 may store an operating system 820 utilized to control the operation of the computer 800. According to one example, the operating system 820 comprises the LINUX operating system. According to another example, the operating system comprises the WINDOWS® SERVER operating system from MICROSOFT Corporation of Redmond, Washington. According to further examples, the operating system may comprise the UNIX operating system or one of its variants. It may be appreciated that other operating systems may also be utilized. In one example, the operating system(s) may include an Internet of Things (IOT) supported operating system developed and distributed by MICROSOFT, LINUX, UNIX, or other operating system provider. The storage device 818 may store other system or application programs and data utilized by the computer 800.

In one example, the storage device 818 or other computer-readable storage media is encoded with computer-executable instructions which, when loaded into the computer 800, transform the computer from a general-purpose computing system into a special-purpose computer capable of implementing the examples described herein. These computer-executable instructions transform the computer 800 by specifying how the CPUs 804 transition between states, as described above. According to one example, the computer 800 has access to computer-readable storage media storing computer-executable instructions which, when executed by the computer 800, perform the various processes described above with regard to FIGS. 1 through 7. The computer 800 may also include computer-readable storage media having instructions stored thereupon for performing any of the other computer-implemented operations described herein.

The computer 800 may also include one or more input/output controllers 816 for receiving and processing user input from input devices, such as a keyboard, a mouse, a touchpad, a touch screen, an electronic stylus, or other type of input device. Similarly, an input/output controller 816 may provide output to a display, such as a computer monitor, a flat-panel display, a digital projector, a printer, or other type of output device. It will be appreciated that the computer 800 might not include all of the components shown in FIG. 8, may include other components that are not explicitly shown in FIG. 8, or might utilize an architecture completely different than that shown in FIG. 8.

As described herein, the computer 800 may comprise one or more of the target carrier 110, the remote control device 112, and/or other systems or devices associated with the target systems 100, 400 and/or remote from the target systems 100, 400. The computer 800 may include one or more hardware processor(s) such as the CPUs 804 configured to execute one or more stored instructions. The CPUs 804 may comprise one or more cores. Further, the computer 800 may include one or more network interfaces configured to provide communications between the computer 800 and other devices, such as the communications described herein as being performed by the target carrier 110, the remote control device 112, and other devices described herein. The network interfaces may include devices configured to couple to personal area networks (PANs), wired and wireless local area networks (LANs), wired and wireless wide area networks (WANs), and so forth. For example, the network interfaces may include devices compatible with Ethernet, Wi-Fi™, and so forth.

The programs 822 may comprise any type of programs or processes to perform the techniques described in this disclosure for the target carrier 110 and the remote control device 112 as described herein. The programs 822 may enable the devices described herein to perform various operations.

CONCLUSION

The examples described herein provide target systems, target carriers, and associated systems, methods, applications, data, computer program products, non-transitory computer-readable medium storing instructions. These systems and device provide a superior target system for the training of laypersons, intermediary shooters, and expert marksmen.

While the present systems and methods are described with respect to the specific examples, it is to be understood that the scope of the present systems and methods are not limited to these specific examples. Since other modifications and changes varied to fit particular operating requirements and environments will be apparent to those skilled in the art, the present systems and methods are not considered limited to the example chosen for purposes of disclosure and are considered to cover all changes and modifications which do not constitute departures from the true spirit and scope of the present systems and methods.

Although the application describes examples having specific structural features and/or methodological acts, it is to be understood that the claims are not necessarily limited to the specific features or acts described. Rather, the specific features and acts are merely illustrative of some examples that fall within the scope of the claims of the application.

What is claimed is:

1. A target system comprising:
a carrier comprising:
a housing;
at least one wheel rotatably coupled to an interior of the housing;
at least one gear coupled to the at least one wheel;
a motor coupled to the at least one gear to drive the at least one wheel via the at least one gear;
a controller to activate the motor based on user input;
at least one arm coupled to the carrier;
a coupling device to couple a panel to the at least one arm;
a sensor to detect environmental conditions external to the carrier and alter functions of the target system; and
a clutch mechanically coupled to the at least one wheel to selectively engage and disengage the at least one wheel from a suspension line.

2. The target system of claim 1, further comprising a suspension line, wherein the carrier hangs from the suspension line via the at least one wheel.

3. The target system of claim 1, further comprising:
a transceiver communicatively coupled to the controller; and
a remote control device communicatively couplable to the transceiver via a wireless communication protocol, the remote control device configured to transmit the input.

4. The target system of claim 3, wherein the remote control device transmits the input to the transceiver, the input causing the controller to activate the motor to move in a first direction, move in a second direction, stop, pause, delay, reduce speed during movement, reduce acceleration during movement, increase speed during movement, increase acceleration during movement, move randomly, move in a pre-defined pattern, or combinations thereof.

5. The target system of claim 1, wherein:
the at least one wheel comprises at least two wheels, and
a first wheel of the at least two wheels is contrapositioned to a second wheel of the at least two wheels with respect to a suspension line threaded between the first wheel and the second wheel.

6. The target system of claim 1, further comprising an aperture defined in the housing through which a suspension line is selectively engageable and disengageable with the at least one wheel.

7. The target system of claim 1, wherein the housing is made of a hardened steel.

8. A target carrier comprising:
a housing;
at least one wheel rotatably coupled to an interior of the housing;
at least one gear coupled to the at least one wheel;
a motor coupled to the at least one gear to drive the at least one wheel via the at least one gear;
a controller to activate the motor based on user input; and
a sensor to detect user presence and alter movement of the target carrier; and
a clutch mechanically coupled to the at least one wheel to selectively engage and disengage the at least one wheel from a suspension line.

9. The target carrier of claim 8, further comprising:
at least one arm coupled to the housing; and
a coupling device to couple a panel to the at least one arm.

10. The target carrier of claim 8, further comprising a transceiver communicatively coupled to the controller, the transceiver configured to communicate with a remote control device via a wireless communication protocol, the remote control device transmitting the input to the controller via the transceiver.

11. The target carrier of claim 10, wherein the controller is configured to receive the input via the transceiver, the input causing the controller to activate the motor to move in a first direction, move in a second direction, stop, pause, delay, reduce speed during movement, reduce acceleration during movement, increase speed during movement, increase acceleration during movement, move randomly, move in a pre-defined pattern, or combinations thereof.

12. The target carrier of claim 8, wherein:
the at least one wheel comprises at least two wheels, and
a first wheel of the at least two wheels is contrapositioned to a second wheel of the at least two wheels with respect to a suspension line threaded between the first wheel and the second wheel.

13. The target carrier of claim 8, further comprising an aperture defined in the housing through which a suspension line is selectively engageable and disengageable with the at least one wheel.

14. The target carrier of claim 8, wherein the housing is made of a hardened steel.

15. A target system comprising:

a carrier comprising:

a housing;

at least one wheel rotatably coupled to an interior of the housing;

at least one gear coupled to the at least one wheel;

a motor coupled to the at least one gear to drive the at least one wheel via the at least one gear; and a controller to activate the motor based on user input;

at least one arm coupled to the carrier;

a coupling device to couple a panel to the at least one arm;

a suspension line, wherein the carrier hangs from the suspension line from the at least one wheel; and a clutch mechanically coupled to the at least one wheel to selectively engage and disengage the at least one wheel from a suspension line.

16. The target system of claim 15, wherein:

the at least one wheel comprises at least two wheels, and a first wheel of the at least two wheels is contrapositioned to a second wheel of the at least two wheels with respect to a suspension line threaded between the first wheel and the second wheel.

17. The target system of claim 15, wherein the clutch is mechanically coupled to the at least one wheel to selectively engage and disengage the at least one wheel from a suspension line via actuation of a lever that disengages the at least one wheel allowing the removal of the suspension line via a aperture formed in the housing of the carrier.

18. The target system of claim 15, further comprising an aperture defined in the housing through which a suspension line is selectively engageable and disengageable with the at least one wheel.

19. The target system of claim 1, wherein the clutch further comprising a spring mechanically biased towards the at least one wheel to apply pressure against the suspension line.

20. The target carrier of claim 8, wherein the clutch further comprising a spring mechanically biased towards the at least one wheel to apply pressure against the suspension line.

* * * * *